US008031069B2

(12) United States Patent
Cohn et al.

(10) Patent No.: US 8,031,069 B2
(45) Date of Patent: Oct. 4, 2011

(54) ELECTRONIC SECURITY SEAL AND SYSTEM

(75) Inventors: Oded Yair Cohn, Herzliya (IL); Zvi Ben Shalom, Bat Hadar (IL)

(73) Assignees: Oded Yair Cohn, Herzliya (IL); Zvi Ben-Shalom, D.N. Hof Ashkelon (IL)

( * ) Notice: Subject to any disclaimer, the term of this patent is extended or adjusted under 35 U.S.C. 154(b) by 932 days.

(21) Appl. No.: 12/013,741

(22) Filed: Jan. 14, 2008

(65) Prior Publication Data

US 2009/0179757 A1 Jul. 16, 2009

(51) Int. Cl.
*E05B 45/06* (2006.01)

(52) U.S. Cl. ..... 340/542; 340/426.18; 340/426.19; 340/539.16; 340/539.17; 340/539.22; 340/539.31; 340/566

(58) Field of Classification Search ..... 340/426.18–426.19, 539.22, 539.31, 340/539.16–539.17, 566
See application file for complete search history.

(56) References Cited

U.S. PATENT DOCUMENTS

| | | | | |
|---|---|---|---|---|
| 3,439,320 | A | 4/1969 | Ward | |
| 3,696,384 | A * | 10/1972 | Lester | 367/199 |
| 4,225,953 | A | 9/1980 | Simon et al. | |
| 4,331,356 | A | 5/1982 | Noel | |
| 4,367,458 | A | 1/1983 | Hackett | |
| 4,802,700 | A | 2/1989 | Stevenson et al. | |
| 4,955,000 | A | 9/1990 | Nastrom | |
| 5,005,883 | A | 4/1991 | Guiler | |
| 5,097,253 | A * | 3/1992 | Eschbach et al. | 340/545.1 |
| 5,218,344 | A | 6/1993 | Ricketts | |
| 5,245,317 | A * | 9/1993 | Chidley et al. | 340/571 |
| 5,528,232 | A | 6/1996 | Verma et al. | |
| 5,708,423 | A | 1/1998 | Ghaffari et al. | |
| 5,775,747 | A | 7/1998 | Navarsky | |
| 5,872,516 | A | 2/1999 | Bonge | |

(Continued)

FOREIGN PATENT DOCUMENTS

CA 1326274 1/1994

(Continued)

OTHER PUBLICATIONS

"Sonitor Ultrasound Indoor Positioning System and Awarix Enterprise Patient Care Visability System Bring Acurate Patient, Equipment and Employee Tracking to Medical Center East," pp. 1-4, http://www.hoise.com/vmw/07/articles/vmw/LV-VM-01-07-22.html, Jun. 19, 2007.

*Primary Examiner* — Daniel Wu
*Assistant Examiner* — Son M Tang
(74) *Attorney, Agent, or Firm* — Nixon & Vanderhye PC

(57) ABSTRACT

A tamper-proof electronic security seal which includes a bolt and a locking element and an electronic seal element. The bolt has a head and a hollow shank extending therefrom having a longitudinal bore formed therein. The shank is dimensioned to pass through a lock hasp and has a free end formed for locking engagement with the locking element. The electronic seal element is formed for mechanical connection to the bolt head, and includes an electrical power source, a control unit, communications means responsive to the control unit and a sensor adapted for insertion into the longitudinal bore of the shank, and connected to the control unit. In response to a severing of the shank and the sensor inserted therein, the control unit is operative to activate the communications means to emit an alarm signal.

23 Claims, 13 Drawing Sheets

U.S. PATENT DOCUMENTS

| | | | | |
|---|---|---|---|---|
| 6,069,563 | A * | 5/2000 | Kadner et al. | 340/571 |
| 6,154,139 | A * | 11/2000 | Heller | 340/573.4 |
| 6,265,973 | B1 * | 7/2001 | Brammall et al. | 340/568.1 |
| 6,348,856 | B1 * | 2/2002 | Jones et al. | 340/10.1 |
| 6,420,971 | B1 * | 7/2002 | Leck et al. | 340/542 |
| 6,433,689 | B1 * | 8/2002 | Hovind et al. | 340/573.1 |
| 6,747,558 | B1 * | 6/2004 | Thorne et al. | 340/551 |
| 6,753,775 | B2 * | 6/2004 | Auerbach et al. | 340/539.22 |
| 6,791,465 | B2 * | 9/2004 | Blagin et al. | 340/665 |
| 6,846,024 | B1 | 1/2005 | Palzkill | |
| 6,904,000 | B1 | 6/2005 | Lee | |
| 6,972,677 | B2 * | 12/2005 | Coulthard | 340/531 |
| 6,987,707 | B2 * | 1/2006 | Feintuch et al. | 367/99 |
| 7,042,354 | B2 * | 5/2006 | Auerbach et al. | 340/539.31 |
| 7,061,381 | B2 | 6/2006 | Forcier et al. | |
| 7,135,968 | B2 | 11/2006 | Hosny | |
| 7,190,264 | B2 * | 3/2007 | Brown et al. | 340/539.23 |
| 7,564,350 | B2 * | 7/2009 | Boman et al. | 340/545.6 |
| 7,828,344 | B2 * | 11/2010 | Terry et al. | 292/327 |
| 7,900,980 | B2 * | 3/2011 | Terry et al. | 292/327 |
| 7,936,266 | B2 * | 5/2011 | Francis et al. | 340/545.1 |
| 2005/0231365 | A1 | 10/2005 | Tester et al. | |
| 2006/0013070 | A1 | 1/2006 | Holm et al. | |
| 2006/0077759 | A1 | 4/2006 | Holm | |
| 2007/0109097 | A1 * | 5/2007 | Coutermarsh et al. | 340/5.73 |

FOREIGN PATENT DOCUMENTS

| | | |
|---|---|---|
| EA | 2552 | 6/2002 |
| GB | 2296841 | 7/1996 |
| JP | 1195596 | 8/1989 |
| JP | 1195597 | 8/1989 |
| JP | 3176252 | 7/1991 |
| JP | 2001127666 | 5/2001 |
| JP | 2002300157 | 10/2002 |
| JP | 2004166281 | 6/2004 |
| JP | 2004180300 | 6/2004 |
| JP | 2005309621 | 11/2005 |
| JP | 2005276001 | 10/2006 |
| WO | 03/007221 | 1/2003 |

* cited by examiner

ELECTRONIC SECURITY SEAL AND SYSTEM

FIELD OF THE INVENTION

The present invention relates to security seals for cargo containers and the like, and particularly to smart seals and cargo security systems.

BACKGROUND OF THE INVENTION

It is well known to secure cargo containers by the use of mechanical seals. The purpose of using seals is two fold, namely, to prevent, or at least render difficult, breaking into cargo containers, and to make sure that any such attempts do not go undetected.

The simplest type of such mechanical seals includes a steel bolt composed of a shank with a shank head formed at one end and a free end adapted for locking engagement with a locking element. A typical PRIOR ART seal is seen in FIG. 2. In use, the bolt is positioned so as to pass through the hasp of a container locking mechanism, thereby to prevent opening of the locking mechanism without breaking the seal. Over the years, such seals have become increasingly sophisticated, and have advanced so as to include means for indicating an attempt at tampering with or removing the seal, such as disclosed in U.S. Pat. No. 5,005,883 to Guiler.

A significant problem with cargo container seals is that most attempts at pilfering or break in occur during transportation or transfer of the cargo containers, and even if a break in is seen to have happened, it will often be a long time after the event, and it is generally not possible to prevent such break ins, to catch perpetrators, or even to identify the location and timing of the break in.

There have also been developed electronic tagging devices such as those which include a digital data memory, in which is stored data pertaining to the cargo container and its contents. Such devices are typically RFID devices which are remotely interrogatable. Advantages of electronic tagging devices is that they enable relatively easy, electronic inspection of a large number of containers, and, if connected to a central control center, they also can enable real time knowledge of attempted break ins.

U.S. Pat. No. 6,265,973 to Brammall et al., entitled Electronic Security Seal (the '973 patent), discloses a seal in which an insulated electrically conductive bolt is adapted for locking together with a locking mechanism so as to complete therewith an electrical circuit connected to electronic apparatus which is adapted to generate a tamper evident RF signal if the bolt is removed or severed. The bolt/locking mechanism interface must be specially sealed so as to prevent the ingress of moisture into the electronics.

Advantages of employing RFID devices in conjunction with electronic seals include the ability to interrogate multiple cargo containers or other secured objects, simultaneously and remotely.

As an omni-directional communications medium, RF technology is far superior for many purposes than various line of sight media, such as infrared, as the latter requires—by definition—an unobstructed and substantially direct line of sight, and a single signal receiver is able to receive signals from a single transmitter only.

However, the use of RFID devices in the protection of cargo containers, trucks, and other security and tracking applications, has a number of disadvantages, including the simultaneous reception of multiple potentially overlapping and garbled messages by a single interrogator device, as discussed in the above-referenced '973 patent. Furthermore, notwithstanding the fact that RF signals may be encoded, it is nonetheless possible for unauthorized persons to intercept such signals, thereby compromising the security of the cargo.

It is also known to use ultrasound technology, for the tracking of people or objects within enclosed areas such as buildings. Ultrasound is far less useful medium than RF, however, requiring an angular 'field' of view, and being poorly conducted in air such that receivers must be placed within a short range. It does possess, however, the advantage of not causing electronic interference with computer systems, including sensitive medical instruments. Accordingly, it is worth 'paying the price' when it comes to tracking systems in hospitals, office premises, and other enclosed locations in which tracking of small objects and people may be highly desirable, but wherein RF systems are impractical.

Representative of prior art uses of ultrasound technology for purposes such as mentioned above, are the following:

U.S. Pat. No. 3,439,320 entitled Personnel Location System. This document relates to a system in which each of a plurality of persons whose location is to be ascertained carries a transmitter that produces an ultrasonic sound signal having a unique frequency. Each room or area to be designated has an ultrasonic receiver or transducer capable of sensing any of the unique frequencies within its range. The ultrasonic transducers in the different areas are all coupled to a display panel capable of indicating the designated areas and each person to be located. When a person actuates his transmitter in one of the areas, an indication is given on the control panel of the location of this person at a designated area. Preferably, the indication is maintained until the person moves to a different area and actuates his transmitter there.

U.S. Pat. No. 3,696,384 to Lester, entitled Ultrasonic Tracking And Locating System. This document discloses an ultrasonic tracking and locating system in which an identification code number is programmed on a console keyboard to activate an encoder which transmits a plurality of coded pulses to a plurality of transceiver units located in the rooms of a building where surveillance is desired. A transducer in the transceiver transmits a coded, ultrasonic digital signal which is dispersed throughout the room. Portable pocket unit transceivers carried by persons to be located receive the transmitted ultrasonic signals and decode the signals to determine if they correspond to the pocket unit's identification code. If the signal corresponds to the pre-programmed code, the pocket unit transmits a single ultrasonic pulse which is received by the room transceiver and is transmitted back to the console, where a display converter activates a digital readout display to provide a visual, numerical indication of the location of the person.

U.S. Pat. No. 4,225,953 to Simon et al., entitled Personnel Locator. This document discloses a personnel locator and display system for indicating on a status board the room numbers where designated key individuals are located at a given moment. Small portable transmitters, either ultrasonic or radio frequency, are worn by the key individuals, and receivers are provided in the rooms. The various transmitters emit pulses according to a preprogrammed timing sequence, and a decoding logic network connected to receiver signals received in the rooms identifies the specific transmitter and room number and displays same on a status board. A programmer-recharger unit programs the pulse timing for each transmitter for identification of the wearer.

U.S. Pat. No. 4,367,458 to Hackett, entitled Supervised Wireless Security System. This document discloses an ultrasonic communication system capable of wireless installation and supervised operation is achieved by communicating each information bit as two distinct ultrasonic frequencies separated in frequency enough to assure that the signal strength of both transmissions will not be in a deep null at the receiver location at the same time. The transmissions can be coded with a format that recognizes the correct data transmission even if reception of one frequency is lost. By use of transponders and other auxiliary units with periodic polling, supervised operation throughout a building can be maintained with events such as intrusion, fire or emergency as well as failures of particular units of the system reported.

U.S. Pat. No. 4,955,000 to Nastrom, entitled Ultrasonic Personnel Location Identification System. This document discloses an ultrasonic system for identifying the location of personnel within a multiple room complex. The system includes ultrasonic transmitters adapted to be transported by the personnel. The transmitters periodically transmit pulse code modulated (PCM) transmitter signals representative of a digital code sequence characteristic of the person, and formed by a plurality of bit positions which are separated from adjacent bit positions by predetermined time intervals. Ultrasonic receivers for receiving the transmitter signals are positioned within each room of the complex. The receivers detect bits of the code sequence only during window periods corresponding to expected bit positions. Detected code sequences are compared to predetermined code sequences, and receiver signals are produced as a function of the comparison. A central station is coupled to receive the receiver signals, and provides a visual indication of the rooms in which the persons transporting the transmitters are located.

U.S. Pat. No. 5,218,344 to Ricketts, entitled Method And System For Monitoring Personnel. This document discloses a method and system for monitoring personnel in an institution such as a correctional facility, hospital, school, military installation, and the like. The system includes a computer connected with one or more stationary transceivers in a defined area of the facility, and a portable transceiver unit worn by each individual who is to be monitored. The computer sends command signals to the stationary transceivers, which broadcast interrogation signals to the portable units. The portable units are configured to respond only to interrogation signals unique to that individual, and upon decoding an interrogation signal incident thereon, broadcast a response signal to the stationary transceivers. The stationary transceivers relay corresponding data to the computer, where the data is analyzed to provide an indication of the number, location and identity of the individuals. The portable transceiver units have an emergency alarm button which may be actuated by the individual in the event of an emergency, and selected portable transceiver units may also be configured to be sensitive to proximity between them. In addition, the portable units may be coded for access to vending apparatus.

U.S. Pat. No. 5,245,317 to Chidley et al., entitled Article Theft Detection Apparatus. This document discloses a method and system for monitoring an item within a defined area and sounding an alarm if the item is removed from the area. A transmitter and transducers emit ultrasound which substantially saturates the area to be monitored. A security tag having a detector and alarm is attached to the items to be monitored within the area. Sensing circuits may be additionally provided to determine whether a security tag is being tampered with or removed by an unauthorized person. The security tag's alarm is sounded in the event that the receiver does not detect the ultrasound indicating that the monitored item is no longer in the monitored area. Additional alarms may be provided for indicating that the security tag has been tampered with or removed.

U.S. Pat. No. 5,708,423 to Ghaffari et al., entitled Zone-Based Asset Tracking And Control System. This document discloses a data processing system which automatically maintains records of respective locations of a plurality of objects in real time. Each of the objects has secured thereto a respective object marker which transmits an identification signal that is unique to the respective object. Sensor devices are installed at respective doorways of a building. Each sensor device receives the identification signal transmitted from the object marker as the respective object is moved through the doorway. The sensor device detects from the identification signal a direction in which the object is being moved through the doorway and generates a detection signal indicative of the detected direction of movement and also indicative of the identification signal for the object. The data processing system receives the detection signals from the sensor devices and maintains a data record with respect to each of the objects indicating the present location in the building of each of the objects.

U.S. Pat. No. 6,433,689 to Hovind et al., entitled System For Supervision And Control Of Objects Or Persons. This document discloses a system for supervision and control of objects or persons within a limited area, such as a building, comprising a plurality of electronic identification chips for placing on respective objects/persons to be supervised/controlled, each chip having stored therein a special ID code and being provided with respective transmitters and receivers for communication via ultrasound as well as audible sound, a plurality of stationary detectors which are interconnected in a network and arranged for two-way communication with the chips, and a central control unit in communication with the chips via the detectors. Each chip is continuously active in operation and is arranged to transmit its ID code at predetermined time intervals. At least one of the detectors or the control unit are arranged to trigger an alarm unit if an incorrect code is received or an approved code is not received continuously at predetermined time intervals.

U.S. Pat. No. 7,061,381 to Forcier et al., entitled Ultrasonic Transmitter And Receiver Systems And Products Using The Same. This document discloses a transceiver preferably embedded within a wearable security watch, PDA, or other device which achieves a variety of wireless ultrasonic and/or radio-frequency based functions, including digital identification and proximity and sensation monitoring of assets, individuals, pets, and the like. The portable or wearable device realizes these functions by periodically polling and receiving information tags within the transmitting distance of the device. The invention can help reduce the likelihood of the theft, loss, or misplacement by detecting that a tag associated with or attached to an entity has left an individual's proximity and sounding an alarm. The device can also assist individuals with sensory impairments, including persons who are deaf, diabetic, and the like, by detecting a tagged entity as it enters the space around an individual, or by detecting environmental stimuli, such as excessive heat in an individual's proximity or vital sign changes, and sounding an alarm.

The use of ultrasound technology has thus found applicability in certain indoor environments, or for uses which require very close contact between items to be monitored, and on an ad hoc, limited basis.

DEFINITIONS

The term "cargo" is used throughout the description below and claims, to mean goods and valuable items of merchandise such as livestock, sought to be transported and stored at a typically open-air secured location or delivered to a secured location. Examples of such cargo include the contents of shipping containers, the contents of secured vehicles such as armored security trucks, and of refueling tanker trucks, particularly containing gasoline.

The term "cargo container" is used to mean a transportable container for containing cargo, such as shipping containers, secured vehicles such as armored security trucks, and refueling tanker trucks.

The term "secured location" is intended to include any of the following:

a) a stationary facility which may be exposed to atmospheric and environmental elements, such as cargo container compounds as may be found at cargo seaports, airports or other transportation terminals;

b) a mobile facility, such as a cargo container ship, a semi-trailer or flatbed truck, a goods train, and the like, which are used to convey shipping containers or similar cargo holders thereon; and c) a loading or unloading facility, such as a fuel terminal or a refueling station for fuel-driven vehicles.

SUMMARY OF THE INVENTION

The present invention seeks to provide an improved electronic security seal which overcomes disadvantages of the known art.

The present invention also seeks to provide an improved electronic security seal which has increased simplicity in construction and use, and increased functionality and utility when compared with the known art.

The present invention also seeks to provide a security and tracking system characterized by increased security and reliability when compared with the known art.

There is thus provided an improved security seal and system for securing, monitoring and tracking the status and spatial position of a plurality of objects located in any of a plurality of secured locations which may be exposed to atmospheric and environmental elements, such as cargo container compounds as may be found at cargo ports.

The system employs a tamper-proof, preferably ultrasonic, electronic security seal for mechanical prevention of pilfering of the contents of a cargo container and further for emitting an alarm signal in response to an attempt to pilfer the contents. The security seal also has an electronic memory which may be preprogrammed to contain details of the bill of lading, container identity, full cargo details, location, and other useful information.

The system also includes a plurality of stationary terminals positioned at predetermined stationary locations within the secured locations, the stationary terminals being arranged for communication with one or more control centers in a control system. The control system may be hierarchical, and may also include GPS units employed within each seal, thereby to facilitate not only real time knowledge of status of each container, but also the geographical location thereof. This is particularly significant for monitoring the progress and secured status of sea bound cargo in real time, which, by definition, is in continuous motion for long periods of time.

More specifically, in accordance with a preferred embodiment of the present invention, there is provided a tamper-proof electronic security seal which includes:

a. a bolt and a locking element, the bolt having a head and a hollow shank extending therefrom having a longitudinal bore formed therein, the shank being dimensioned to pass through a lock hasp and having a free end formed for locking engagement with the locking element;

b. an electronic seal element formed for mechanical connection to the bolt head, and including:

(i) an electrical power source;

(ii) a control unit;

(iii) communications apparatus responsive to the control unit; and (iv) a sensor adapted for insertion into the longitudinal bore of the shank, and connected to the control unit; and wherein, in response to a severing of the shank and the sensor inserted therein, the control unit is operative to activate the communications apparatus to emit an alarm signal.

Additionally in accordance with a preferred embodiment of the present invention, the electronic seal element includes a housing for the power source, control unit and communications apparatus, wherein the housing is configured to fasten about the bolt head.

Further in accordance with a preferred embodiment of the present invention, the electronic seal element also includes additional sensor apparatus operative to provide a predetermined alarm signal to the control unit which in turn is operative to activate the communications apparatus to emit a further alarm signal in response to an attempt to tamper with the housing.

Additionally in accordance with a preferred embodiment of the present invention, the additional sensor apparatus includes vibration sensor apparatus.

Further in accordance with a preferred embodiment of the present invention, the communications apparatus is ultrasonic communications apparatus adapted to communicate with external ultrasonic communications apparatus associated with a security system at a secured location.

Additionally in accordance with a preferred embodiment of the present invention, the ultrasonic communications apparatus may include either an ultrasonic receiver and transmitter pair, adapted to communicate with an external ultrasonic receiver and transmitter pair associated with the security system, or an integral ultrasonic transceiver adapted to communicate with either an external ultrasonic receiver and transmitter pair associated with the security system or an integral transceiver associated therewith.

Further in accordance with a preferred embodiment of the present invention, the ultrasonic communications apparatus is adapted to sense mechanical shock, thereby to function also as apparatus for sensing an attempt to mechanically tamper with the electronic seal element.

Additionally in accordance with a preferred embodiment of the present invention, the sensor is a solid state, probe shaped sensor.

Further in accordance with a preferred embodiment of the present invention, the solid state sensor includes a circuit board carrying thereon an electrical circuit which extends from a connector end which is connected by wire conductors to the control unit, and to a sensor element located at a probe end located distally from the connector end.

Additionally in accordance with a preferred embodiment of the present invention, the sensor element is of the type selected from the group which consists of resistive, capacitive, inductive, or piezoelectric.

Further in accordance with a preferred embodiment of the present invention, the control unit is operative to issue an alarm signal in the event of an unplanned drop in electrical power during operation of the electronic seal element.

Additionally in accordance with a preferred embodiment of the present invention, the electronic seal element also includes a security switch operative to facilitate the provision of power from the power source to the control unit and which, after activation, cannot be deactivated during normal operation of the electronic seal element without causing a break in the electrical power supply.

Further in accordance with a preferred embodiment of the present invention, the electronic seal element also includes actuator apparatus operative for engaging and depressing the security switch, and apparatus for locking the actuator apparatus in its position of engagement with the security switch.

Additionally in accordance with a preferred embodiment of the present invention, the electronic seal element also includes a safety catch for preventing unintended arming of the electronic seal element.

Further in accordance with a preferred embodiment of the present invention, the communications apparatus includes, inter alga, an ultrasonic transmitter, and wherein the alarm signal is operative to activate the ultrasonic transmitter to emit ultrasonic signals within the responsive range of on-site ultrasound responsive alarm units.

Additionally in accordance with a preferred embodiment of the present invention, the ultrasonic signals are within the responsive range of ultrasound responsive mammals.

Further in accordance with a preferred embodiment of the present invention, the electronic security element also includes a programmable memory for storage of container and container-contents related data, and wherein the control unit is operative to selectably store data communicated from external ultrasonic communications apparatus associated with a security system at a secured location, and is further operative to selectably provide thereto data stored in the programmable memory.

In accordance with an alternative embodiment of the invention, there is provided an improved security system for cargo containers located at a secured location, wherein the system includes:

a plurality of uniquely identifiable security seals having ultrasonic communications apparatus for the ultrasonic reception and transmission of data pertaining to a preselected cargo container;

one or more ultrasound communications terminals located at a secured location, for the exchange of data with the ultrasonic communications apparatus of the security seals when in the angular field of view thereof.

Additionally in accordance with the alternative embodiment, the system also includes a control system for receiving and processing real time data relating to the specified cargo containers, and wherein each ultrasound terminal includes apparatus for the transmission of data received from the security seals to the control system.

Further in accordance with the alternative embodiment, the control system includes one or more control centers for receiving and storing data received from the one or more ultrasound terminals relating to the specified cargo containers.

Additionally in accordance with the alternative embodiment, the security system is hierarchical, wherein there are provided two or more two lower level control centers for exchanging data with the one or more ultrasound terminals, the system also including one or more higher level control centers for the storage of data relating to the cargo containers and for exchanging data with each lower level control center.

Further in accordance with the alternative embodiment, the ultrasound communications terminals may include stationary ultrasound communications terminals and portable ultrasound communications terminals.

Preferably, the security seals are tamper-proof electronic security seals, each including:

a. a bolt and a locking element, the bolt having a head and a hollow shank extending therefrom having a longitudinal bore formed therein, the shank being dimensioned to pass through a lock hasp and having a free end formed for locking engagement with the locking element; and b. an electronic seal element formed for mechanical connection to the bolt head;

wherein the electronic seal element includes:

(i) an electrical power source;

(ii) a control unit;

(iii) communications apparatus responsive to the control unit; and (iv) a sensor adapted for insertion into the longitudinal bore of the shank, and connected to the control unit; and wherein, in response to a severing of the shank and the sensor inserted therein, the control unit is operative to activate the communications apparatus to emit an alarm signal.

Additionally in accordance with the alternative embodiment, the communications apparatus is ultrasonic communications apparatus including an ultrasonic receiver and transmitter pair, adapted to communicate with an external ultrasonic receiver and transmitter pair associated with the security system, and wherein the ultrasonic receiver is adapted to sense mechanical shock, thereby to function also as an apparatus for sensing an attempt to mechanically tamper with the electronic seal element.

Further in accordance with the alternative embodiment, the control unit is operative to issue an alarm signal in the event of an unplanned drop in electrical power during operation of the electronic seal element, the alarm signal causing activation of the ultrasonic transmitter to emit ultrasonic signals within the responsive range of on-site ultrasound responsive alarm units, preferably ultrasound responsive mammals.

Additionally in accordance with the alternative embodiment, the secured location is a mobile facility for carrying one or more cargo containers thereon, and there is also provided a GPS link between the lower level control centers and one or more of the higher level control centers for facilitating the monitoring of the geographical location and secure status of all secured cargo containers at a secured location.

DETAILED DESCRIPTION OF THE DRAWINGS

The present invention will be more fully understood and appreciated from the following detailed description taken in conjunction with the drawings, in which.

DETAILED DESCRIPTION OF THE INVENTION

Figure 1A:
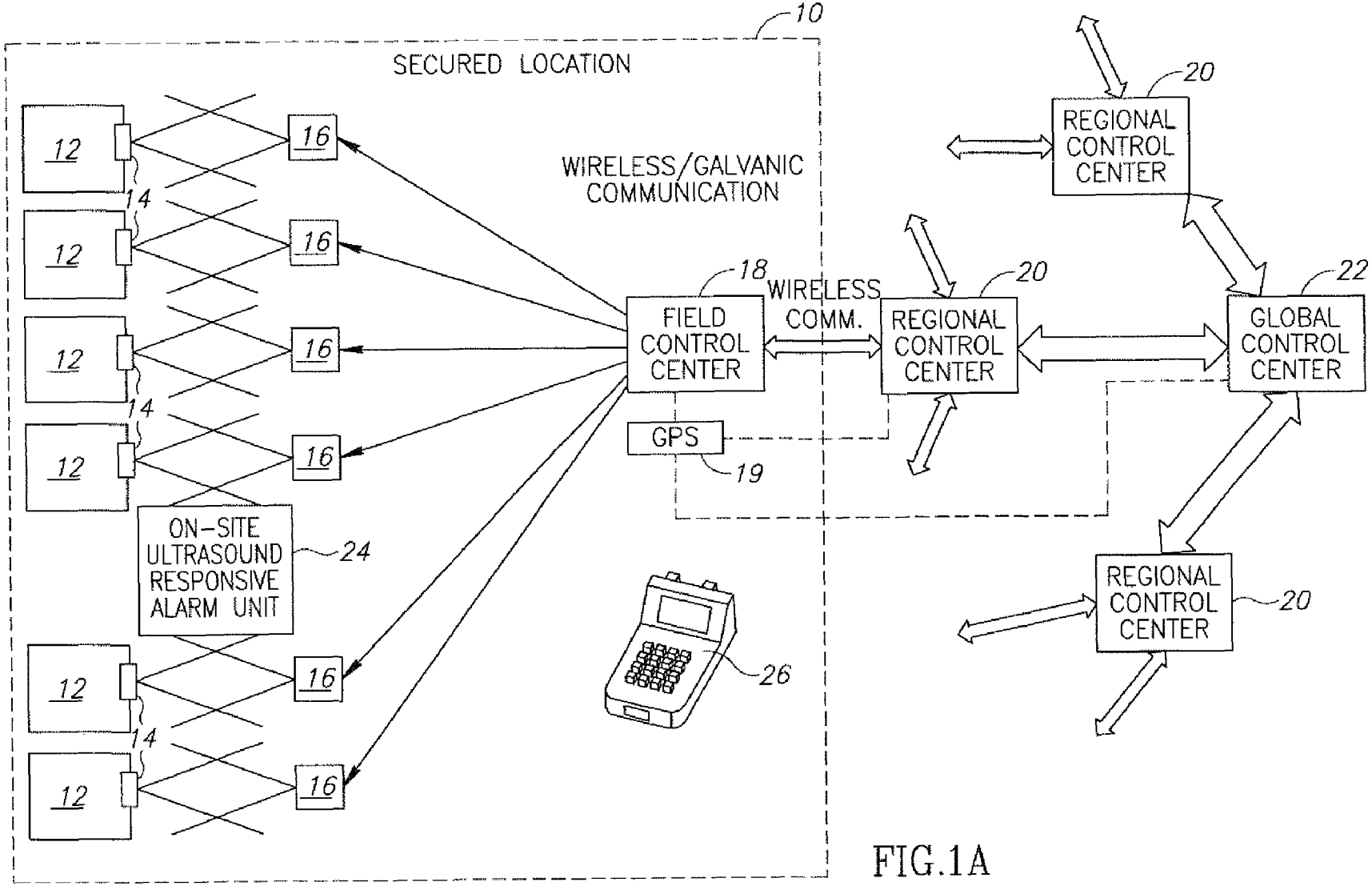
FIG. 1A is a block diagram representation of an improved security system for the protection of cargo at a secured location, constructed and operative in accordance with a preferred embodiment of the present invention.

Referring now to FIG. 1A, the present invention provides a hierarchical security system for the protection, monitoring and tracking of the status and spatial position of cargo containers 12 at a secured location, referenced generally 10, constructed and operative in accordance with a preferred embodiment of the present invention.

The system employs an electronic security seal 14 for mechanically preventing the pilfering of the contents of a cargo container and further for emitting an alarm signal in response to an attempt to pilfer the contents. The security seal 14 also has an electronic memory which may be preprogrammed to contain details of the bill of lading, container identity, full cargo details, location, and other useful information. Seal 14 is described further in detail, hereinbelow.

The system of the invention also includes a plurality of stationary terminals 16 at selected positions within the secured location. The stationary terminals 16 are arranged for interrogating seals 14 and for conveying data via wireless and/or galvanic communication to one or more control centers in a control system. Typically, the control system is hierarchical, and includes a local or 'field' control center 18 for monitoring a single secure location 10. Each of a plurality of field control centers 18 communicates relevant data to a specified regional control center 20 via any suitable communications network, such as may monitor all of the field control centers 18 in a state, country, or other defined territorial region. A global control center 22 is provided for receiving data feeds, via any suitable telecommunications system from a plurality of regional control centers 20. All data transmissions between field control centers 18, regional control centers 20 and global control center 22, as well as any other control levels that may be provided therebetween, are suitably encrypted, thereby preventing unauthorized leakage of information pertaining to the secured cargo.

There may also be provided a direct GPS link 19 between one or more different control levels of the system, typically between a field control center 18 and a regional control center 20 and/or a global control center 22. As the position of each terminal 16 in each secure location is stationary, they facilitate the real time monitoring of the geographical location and secure status of all secured cargo containers 12 when they are in secured locations. This real time monitoring capability is particularly advantageous in respect of the progress and secured status of sea bound cargo, which is in continuous motion for long periods of time, although this capability is also useful with regard to trucks or trains, for example, also functioning as 'secured locations' as defined above.

As will be described hereinbelow in detail, the electronic security seal includes ultrasound communications means, which is employed to communicate with similar communications means mounted on an adjacent terminal 16, within overlapping fields of view, seen in FIGS. 1B and 1C.

The alarm signal may be an electronic signal relayed back to one or more of the control centers 18, 20 and 22, as well as a locally emitted alarm signal emitted in either the audible range, so as to gain the attention of on-site security operatives; or in the ultrasonic range, or both. Ultrasonic signals may also be useful in attracting the attention of on-site ultrasound responsive alarm units 24, particularly ultrasound responsive mammals such as dogs or geese.

In accordance with a preferred embodiment of the invention, there may also be employed portable terminals 26 which may be used by on-site personnel for the programming of seal 14, for the uploading of data thereto, and for data collection therefrom. Communication between terminals 26 and seals 14 is preferably either via ultrasonic means or by cable, thereby ensuring maximum security of such data transmissions.

Figure 1B:
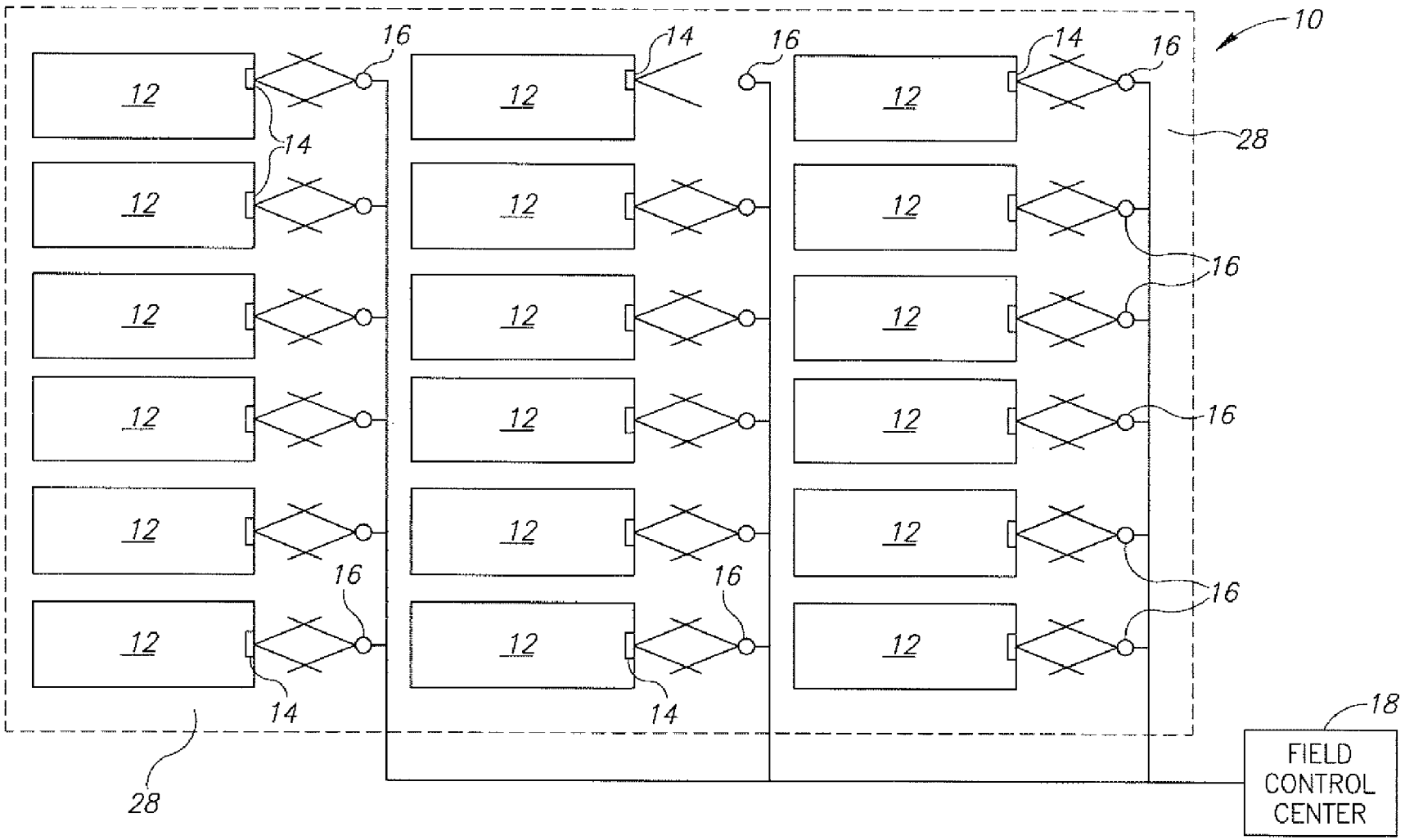
FIG. 1B is a diagrammatic plan view of a secured location for cargo containers, showing a typical arrangement of secured cargo container positions employing security seals of the present invention, stationary terminals, and shaded regions representing areas which are masked to eavesdropping.
Figure 1C:
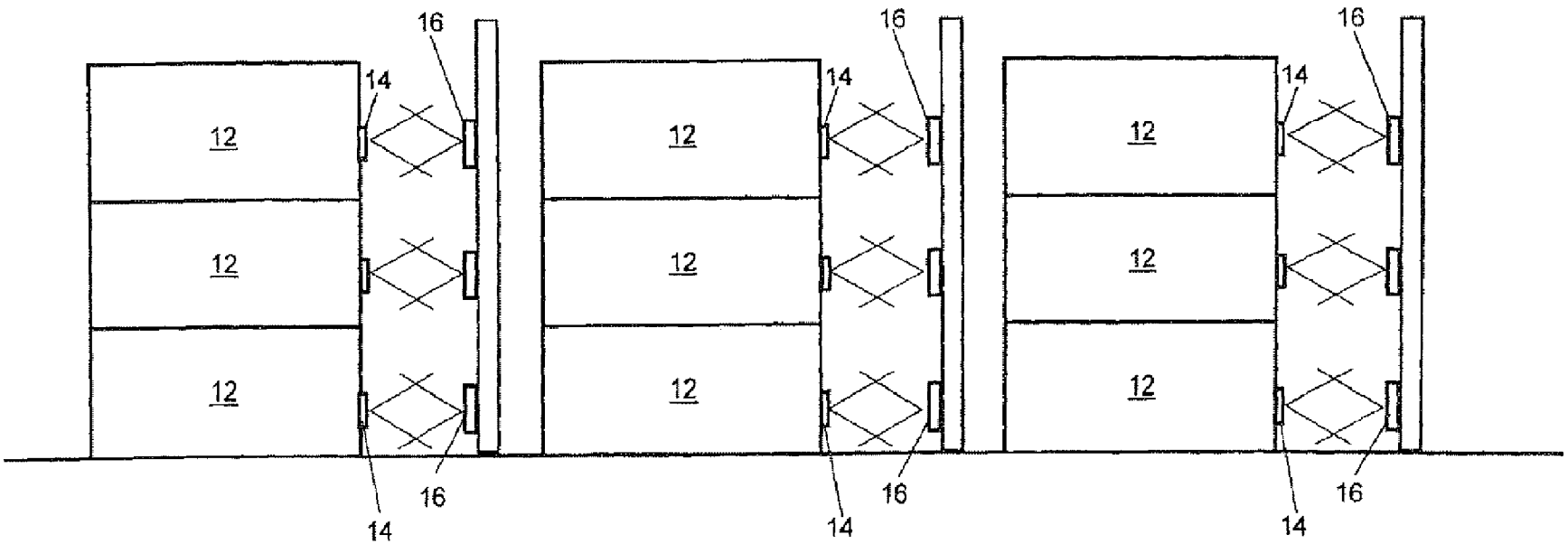
FIG. 1C is a diagrammatic side view of the secured location shown in FIG. 1B.
Figure 2:
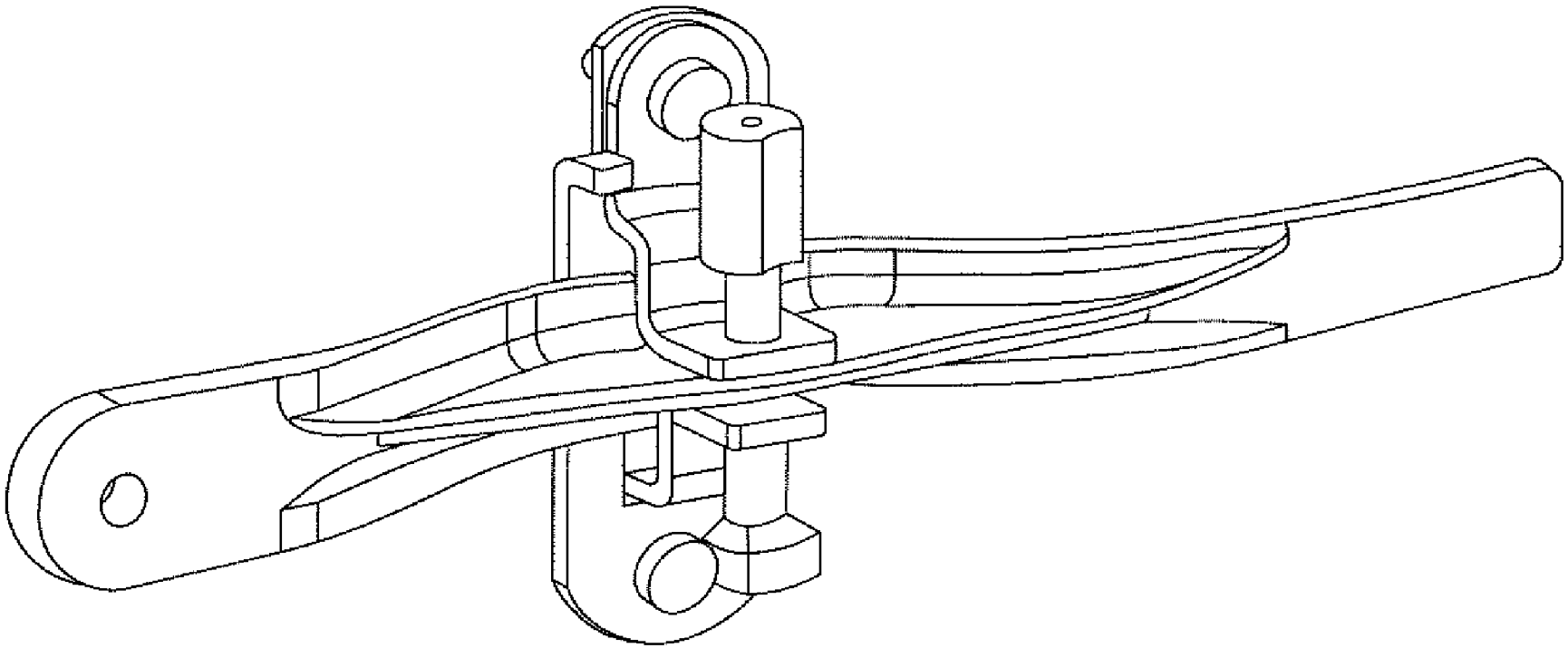
FIG.2 PRIOR ART
FIG. 2 is a schematic illustration of a PRIOR ART seal used to secure cargo shipping containers.
Figure 3:
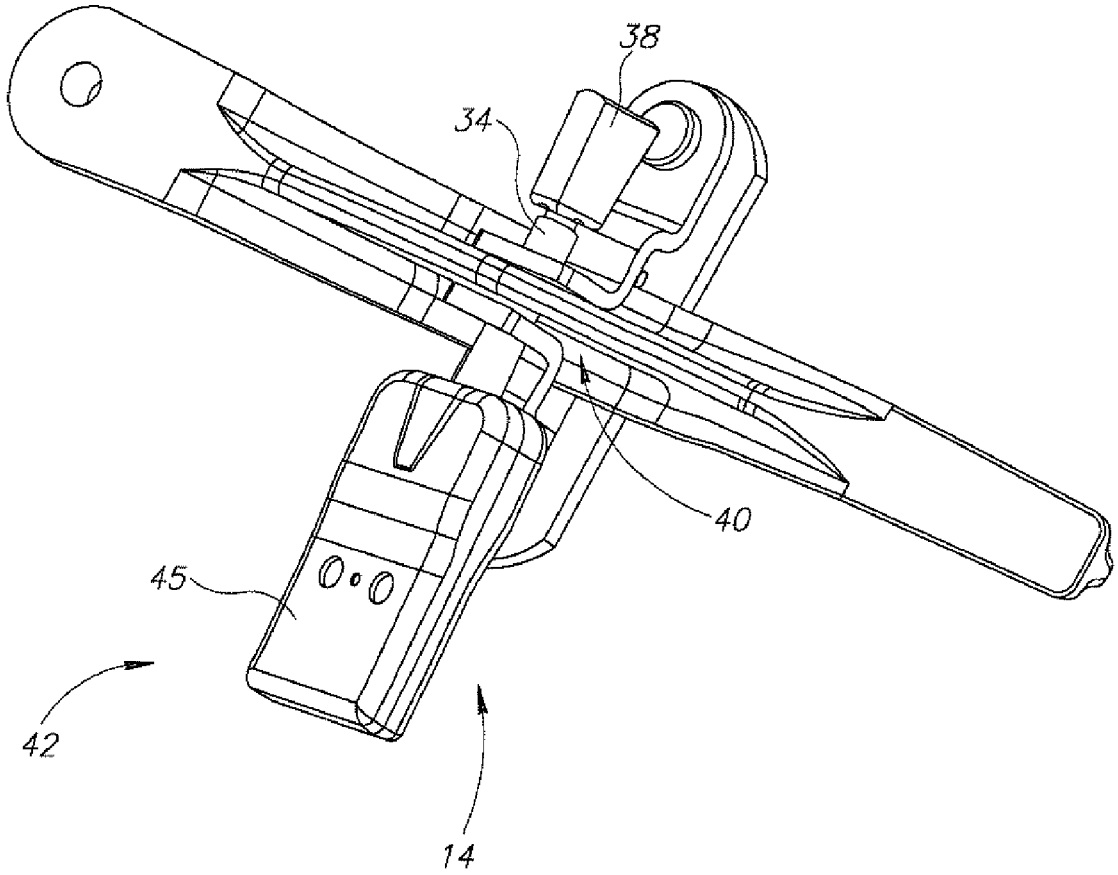
FIG. 3 is a schematic illustration of a seal constructed in accordance with a preferred embodiment of the present invention.

Referring now to FIGS. 1B and 1C, there is seen in diagrammatic form, a typical distribution of secured cargo containers 12 at a secured location 10. As seen, each stationary terminal 16 lies within the angular field of view of seals 14 so as to communicate exclusively therewith. It will be appreciated that each container 12 as illustrated may represent a single container, or, as seen in FIG. 1C, a vertical stack of such containers.

The position of stationary terminal 16 is preferably adjustable, so as to be movable in accordance with logistic requirements at the secured location, as may relate to the size and number of the containers, their precise position of placement, as well as the position of the container lock secured by seal 14. Furthermore, each terminal 16 may be any suitable type of repeater as known in the art, such as disclosed in U.S. Pat. No. 5,449,112 to Heitman et al., entitled Method and Apparatus for Monitoring and Controlling Air Handling Systems or in Published US Patent Application No. 2007/037522 to Liu et al., entitled System and Method for Adaptive Programming of a Remote Control; the contents of which are incorporated herein by reference. Preferably, the direction and height of the repeaters 16 are also adjustable.

Notwithstanding the fact that while ultrasound is known to have excellent underwater propagation characteristics, but poor propagation characteristics in air, the inventor has found that the use of ultrasound is surprisingly advantageous for securing cargo containers in open air facilities, in a manner which requires direct line of sight communications over a very short range. Accordingly, at the illustrated secured location 10, electronic interrogation of any of the seals 14 from the exterior of the secured location, shown in the shaded area referenced 28, is not possible, as any 'eavesdropping' on communications between a terminal 16 and seals 14 would require entry into the overlapping angular fields of view thereof. As will be appreciated from the description of communications protocols below, even if an intruder manages to intercept signals between any of terminals 16 and seals 14, an alarm signal will result very soon after, so as to prevent an effective breach of security.

In accordance with a preferred embodiment of the invention, once a container is known to have entered a secured location, its seal 14 is interrogated periodically, either by a stationary terminal 16 or by a portable terminal 26. If during this period, which may be predetermined according to system requirements, communications cannot be established with the seal, an alarm will be operated, preferably in the seal as well as in one or more control centers.

Referring now to FIGS. 3-6D, there is shown a tamper-proof LOS seal 14, constructed and operative in accordance with a preferred embodiment of the present invention.

Seal 14 includes a bolt 30 having a head 32 (FIGS. 4, 6A and 6C) and a shank 34 extending therefrom. Shank 34 has a free end 36 (FIGS. 4 and 6C) distal from head 32, configured for locking engagement with a mechanical locking element 38. Typically, the exterior configuration and dimensions of shank 34 are as known in the art, and are such that shank 34 is adapted to pass through a standard hasp, referenced 40 (FIG. 3), as known in the art. It will thus be appreciated that use of the LOS seal 14 of the present invention does not require changes to or adaptations of cargo containers or their locking mechanisms. Furthermore, both the locking element 38, and the locking mechanism between shank free end 36 and locking element 38, may be as known in the art, and are thus not detailed herein.

In accordance with the present invention, there is also provided an electronic seal element (ESE), referenced 42. ESE 42 is provided as an integral part of seal 14 and is operative to perform the following functions:

a. store data pertaining to the cargo including the serial number of the container, its own serial number, and generally to contain the bill of lading of the container;

b. communicate with a stationary terminal 16 (FIGS. 1A-1C) at a secured location 10 or with a portable terminal 26 (FIG. 1A) so as to transmit stored data; and c. emit one or more type of alarm signal in the event of an attempt to break or otherwise tamper with the seal, normally indicative of an attempt to break into the container.

Figure 5B:
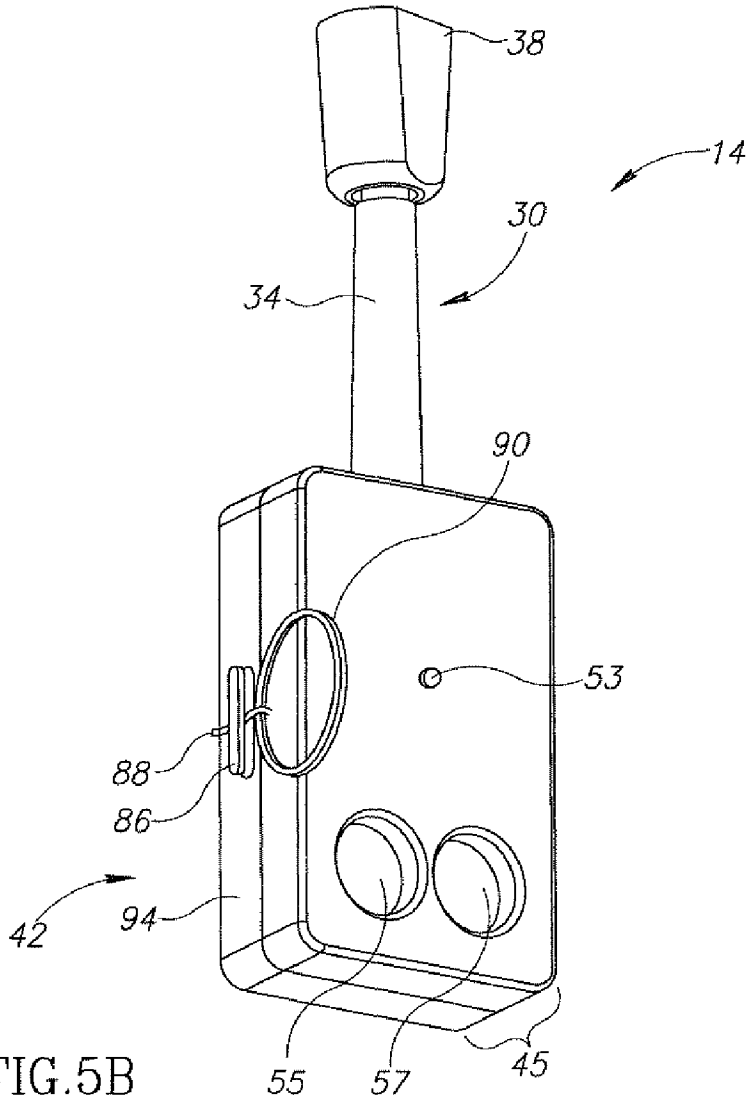
FIGS. 5A and 5B are perspective exterior views of an unarmed, locked seal constructed and operative in accordance with a first embodiment of the invention.
Figure 5A:
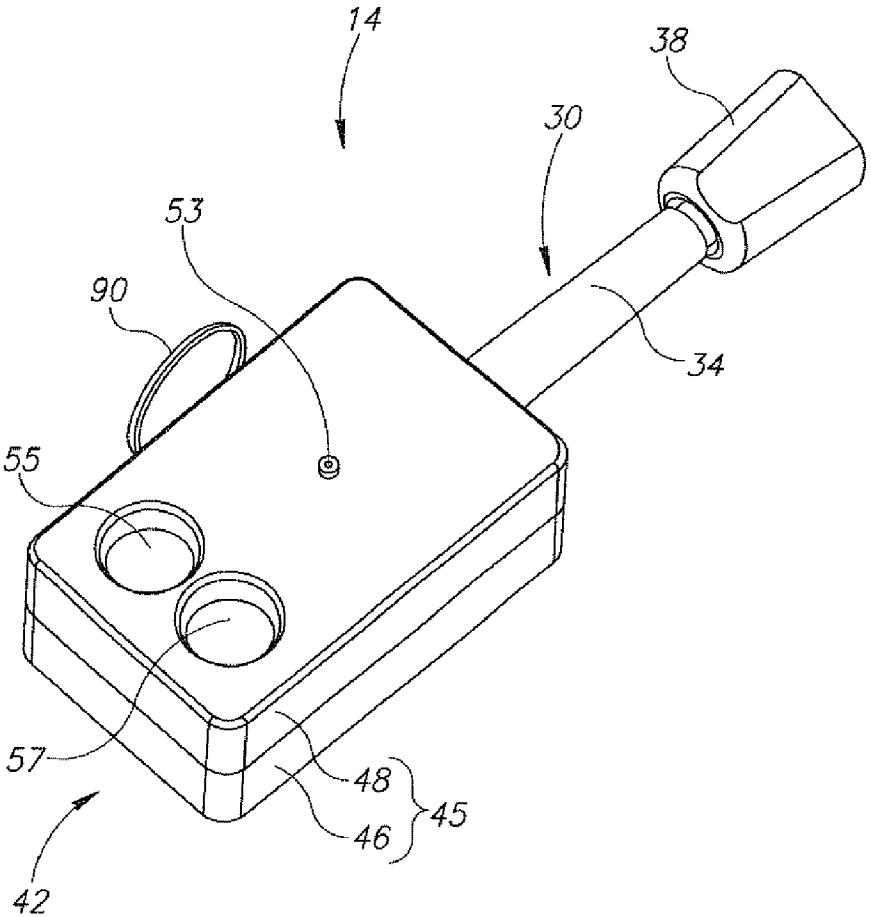
Figure 6A:
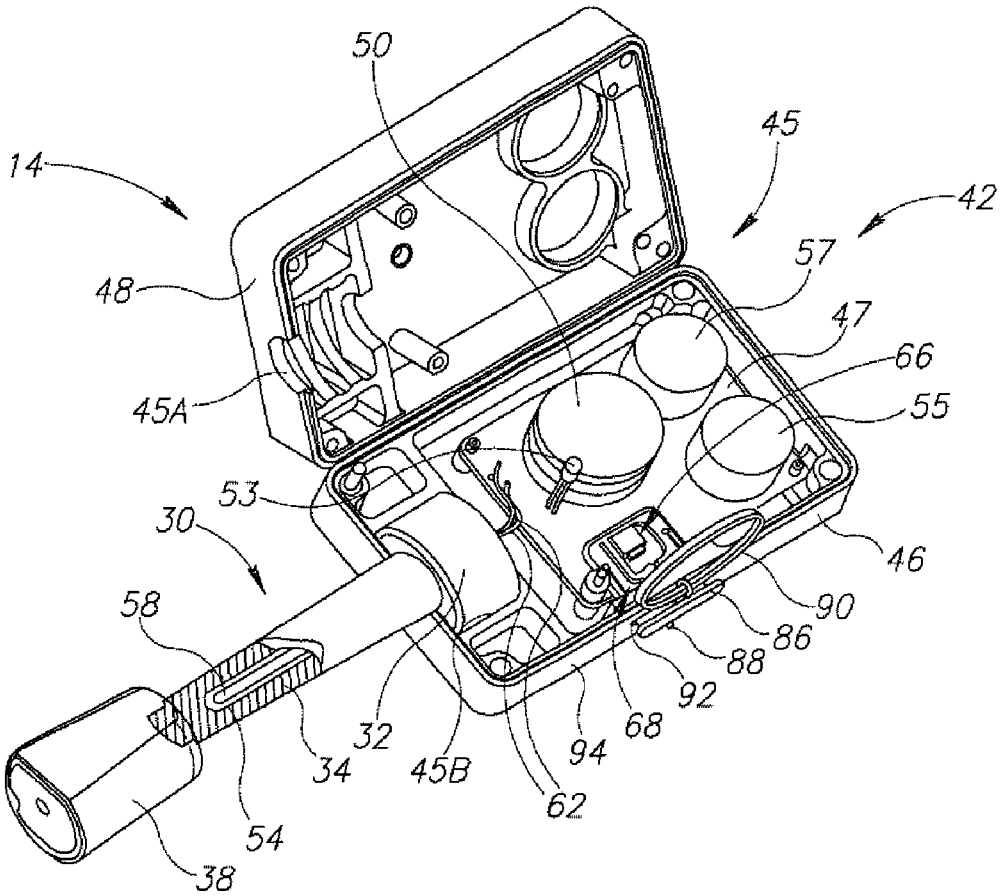
FIG. 6A is a perspective interior view of the seal of FIGS. 5A and 5B in which the programmable electronic seal housing is seen in an open position and prior to arming.
Figure 6B:
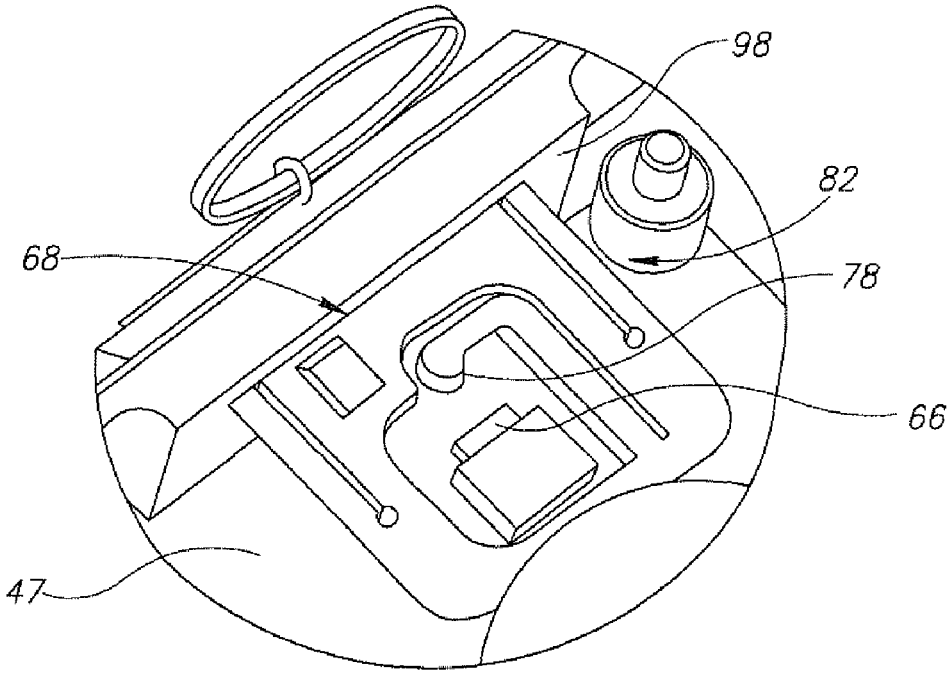
FIG. 6B is an enlarged view of the activation switch depicted in FIG. 6A, in an unarmed position.
Figure 6C:
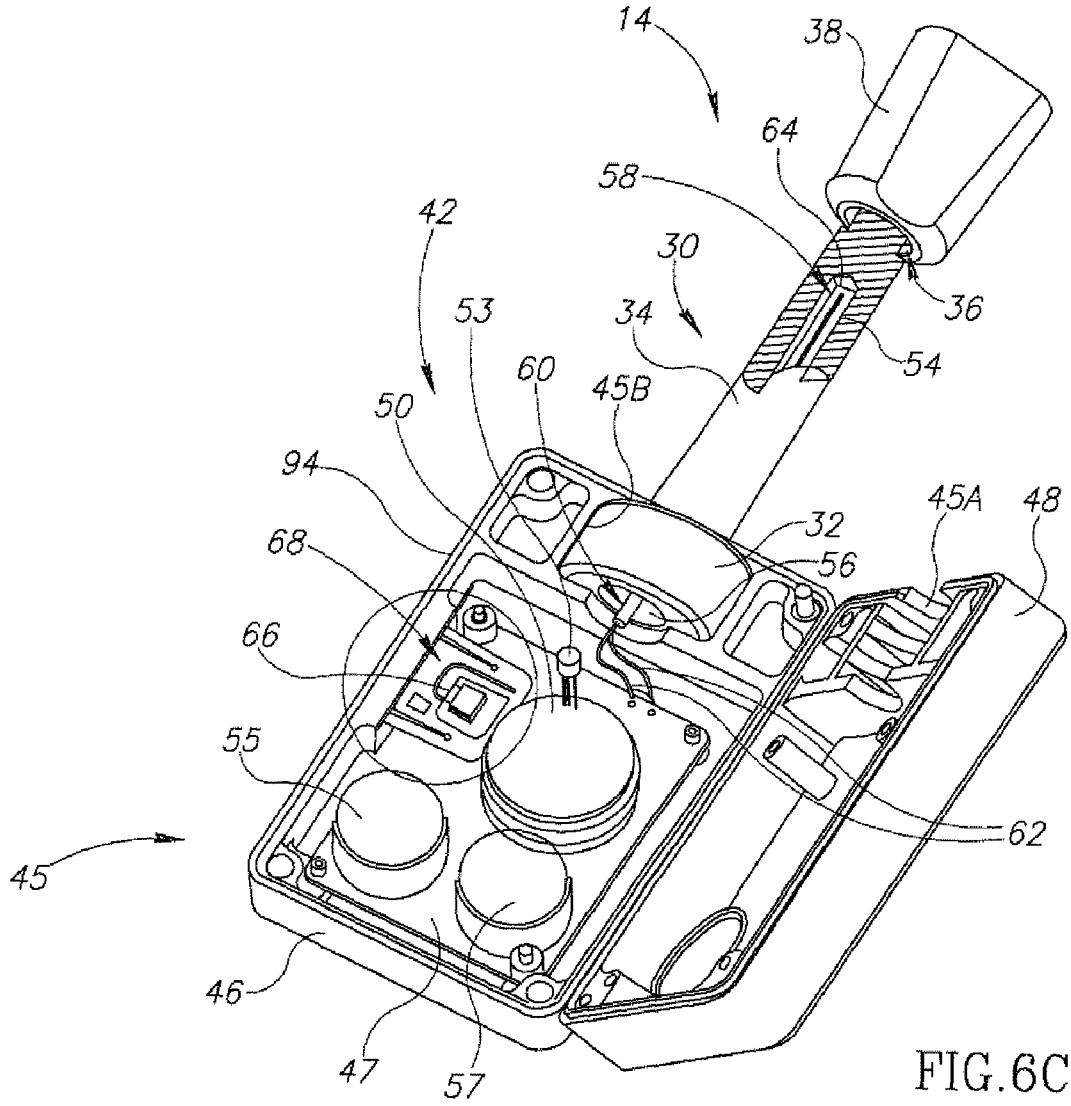
FIG. 6C is a view similar to that of FIG. 6A, but after the seal has been armed.
Figure 6D:
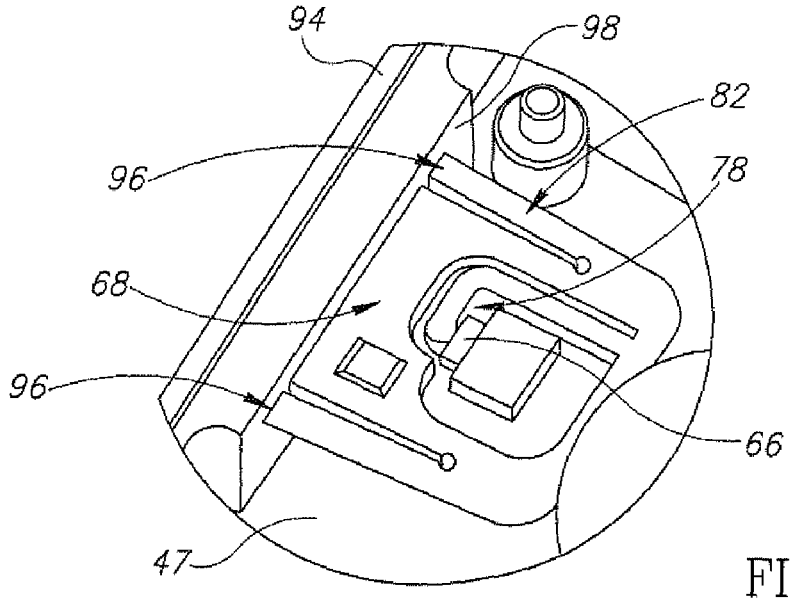
FIG. 6D is an enlarged view of the activation switch in an armed position, as seen in FIG. 6C.

In order to perform the above functions, ESE 42 includes a control unit 52 having associated therewith a programmable memory 59; a bolt protection sensor 58 for detecting significant damage to bolt 30; ultrasound transducers employed as a receiver 55 and a transmitter 57; and a visible alarm indicator 53. The ultrasound transducer pair may be replaced by a suitable integral ultrasound transceiver. As seen in FIGS. 6A and 6C, these components are typically mounted onto a main circuit board 47, arranged in a sealable housing 45. As seen in FIGS. 5A, 5B, 6A and 6C, housing 45 is formed of a base 46 to which is hingedly attached to a cover 48, the base and cover being formed in any suitable manner so as to seal against the ingress of water and other forms of moisture, once closed.

As best shown in FIGS. 6A and 6C, while housing 45 is not directly connected to bolt 30, per se, each of base 46 and cover 48 is formed with a semicircular opening 45*a* and a widened, molded recess 45*b*, such that base 46 and cover 48 close around bolt 30 and bolt head 32, effectively locking ESE 42 thereto.

Figure 4:
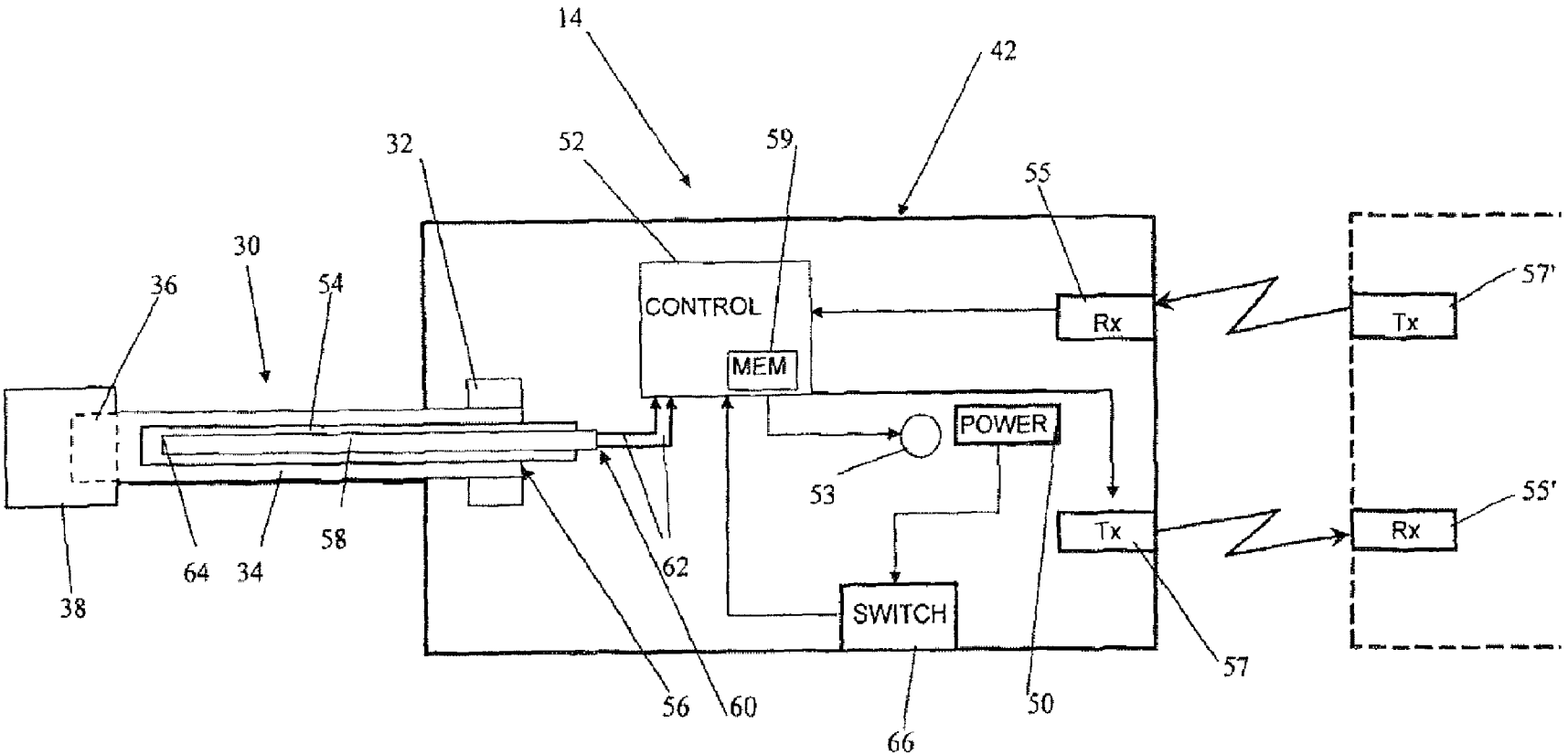
FIG. 4 is a block diagram representation of the seal depicted in FIG. 3, in accordance with a preferred embodiment of the present invention.

In accordance with a preferred embodiment of the invention, the receiver 55 and transmitter 57 pair or transceiver are adapted to communicate with a corresponding transducer pair, shown at 55' and 57' in FIG. 4 or transceiver unit, such as may be provided on each stationary terminal 16 (FIGS. 1A-1C) and on terminal 26. By way of demonstrative example only, the transducers 55, 57, 55' and 57' may be 40 kHz Air Ultrasonic Ceramic Transducers, model number 400ST/R160 and 400ST/S160, as described at internet page: http://kitsrus.com/projects/t400s16.pdf. The description below of the operation of receivers 55 and 55' and transmitters 57 and 57' should be understood as applying equally to an embodiment in which a receiver/transmitter pair is replaced by a suitable ultrasound transceiver.

In accordance with a preferred embodiment of the invention, receiver 55 is operative to communicate with a corresponding transmitter 57' on a stationary terminal 16 (FIGS. 1A-1C) or portable terminal 26 (FIG. 1A), when initially installed on a container 12 (FIGS. 1A-1C) to receive programming data for storage in memory 59; and when at a secure location 10, to receive interrogation signals monitoring the status of seal 14 and associated container 12, and confirming the position thereof. Similarly, transmitter 57 is operative to transmit data to a corresponding receiver 55' on a stationary terminal 16 (FIGS. 1A-1C) or portable terminal 26 (FIG. 1A), during various stages of the initial installation and programming; and when at a secure location 10, to emit signals containing identity, cargo information, and status.

In addition to the above functions, receiver 55 and transmitter 57 may also be employed to serve additional tasks so as to provide ESE 42 and thus seal 14 with additional functionality. Specifically, ultrasonic receiver 55 can also be employed to detect vibrations such as may be caused by an attempt to break seal 14 generally and ESE 42 specifically. The use of ultrasonic receivers as vibration sensors is well known in the art, due to the fact that a mechanical shock contains a wide range of acoustic frequencies, including some which are within the range of the ultrasonic receivers.

Furthermore, in the event that an alarm situation arises, transmitter 55 may be operated to emit an ultrasound signal which is received by receiver 57' of stationary terminal 16 or portable terminal 26 so as to provide an alarm indication at control center 18 (FIG. 1A), while at the same time being audible to the on-site ultrasound responsive alarms units 24, such as dogs or geese, so to alert them. At the time of an alarm, visible alarm indicator 53, which is typically an LED, is also activated, typically in a flashing mode.

Figure 8:
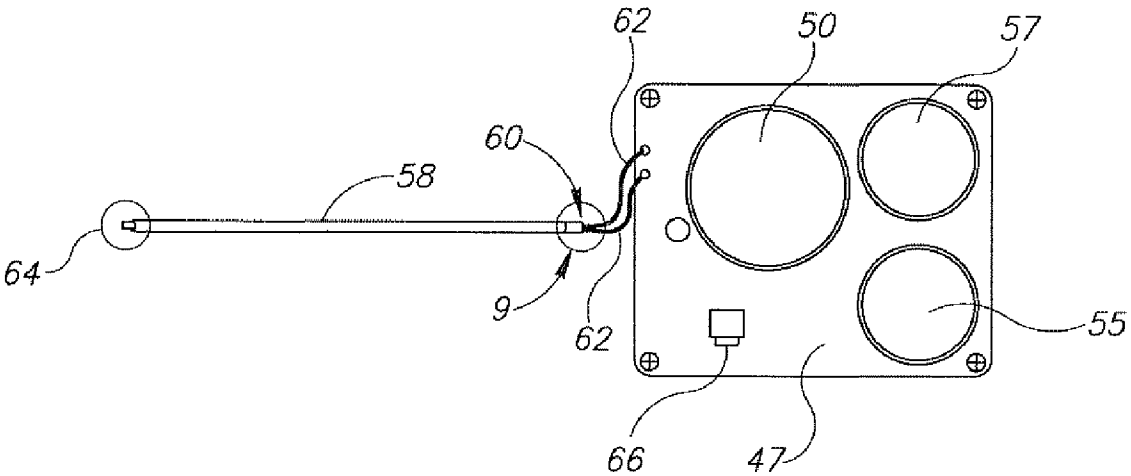
FIG. 8 is a simplified plan view of operational components of the electronic seal of FIGS. 6A and 6C.
Figure 9:
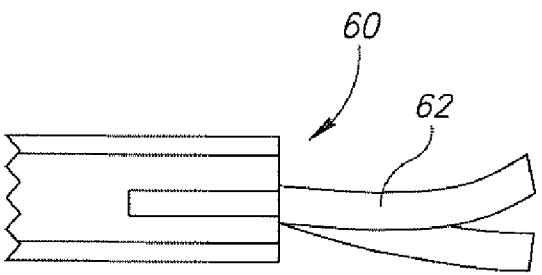
FIG. 9 is an enlarged illustration showing the connection between the electronic seal probe and the remainder of the electronics of the seal, indicated at region 9 in FIG. 8.
Figure 10:
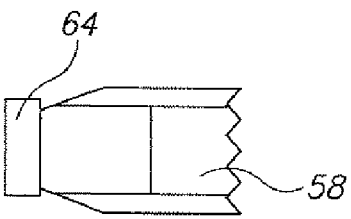
FIG. 10 is an enlarged illustration of the tip of the probe of the electronic seal of FIGS. 6A, 6C and FIG. 8.

Referring now to FIGS. 4, 5A, 5B, 6A, 6C, 8, 9 and 10, and as described above, the shank 34 of bolt 30 (FIGS. 4, 5A, 5B, 6A and 6C) may have an external form that is no different from that of prior art mechanical seal bolts. Internally however, bolt 30 is modified by provision therein of a bore 54, starting at an opening 56 (FIGS. 4 and 6C) at the bolt head 32, and extending along a major portion of the shank 34, as seen in FIGS. 6A and 6C.

In order to impart the basic, mechanical portion of LOS seal 14 with alarm capabilities which will emit alarm signals in response to an attempt to cut through the bolt 30, bolt protection sensor 58 is preferably provided as a solid state, finger shaped printed circuit board. The circuit board carries thereon an electrical circuit which extends from a connector end 60 which is connected by wire conductors 62 to control unit 52 (FIG. 4), to a sensor tip 64, shown in detail in FIG. 10, located at a probe end distal from connector end 60. Sensor tip 64 has thereat a sensor element which may be a resistive, capacitive, inductive, piezoelectric or any other suitable sensor element. Bolt protection sensor 58 is positioned within bore 54 (FIGS. 6A and 6C) in non-touching contact therewith so as to be electrically insulated therefrom. Once ESE 42 has been activated, control unit 52 constantly monitors the state of electrical activity within bolt protection sensor 58. In response to a change in the state of electrical activity of sensor 58, caused, for example, during an attempt to cut through bolt shank 34, control unit 52 will immediately operate transmitter 57 so as to emit alarm signals as described above.

Figure 11:
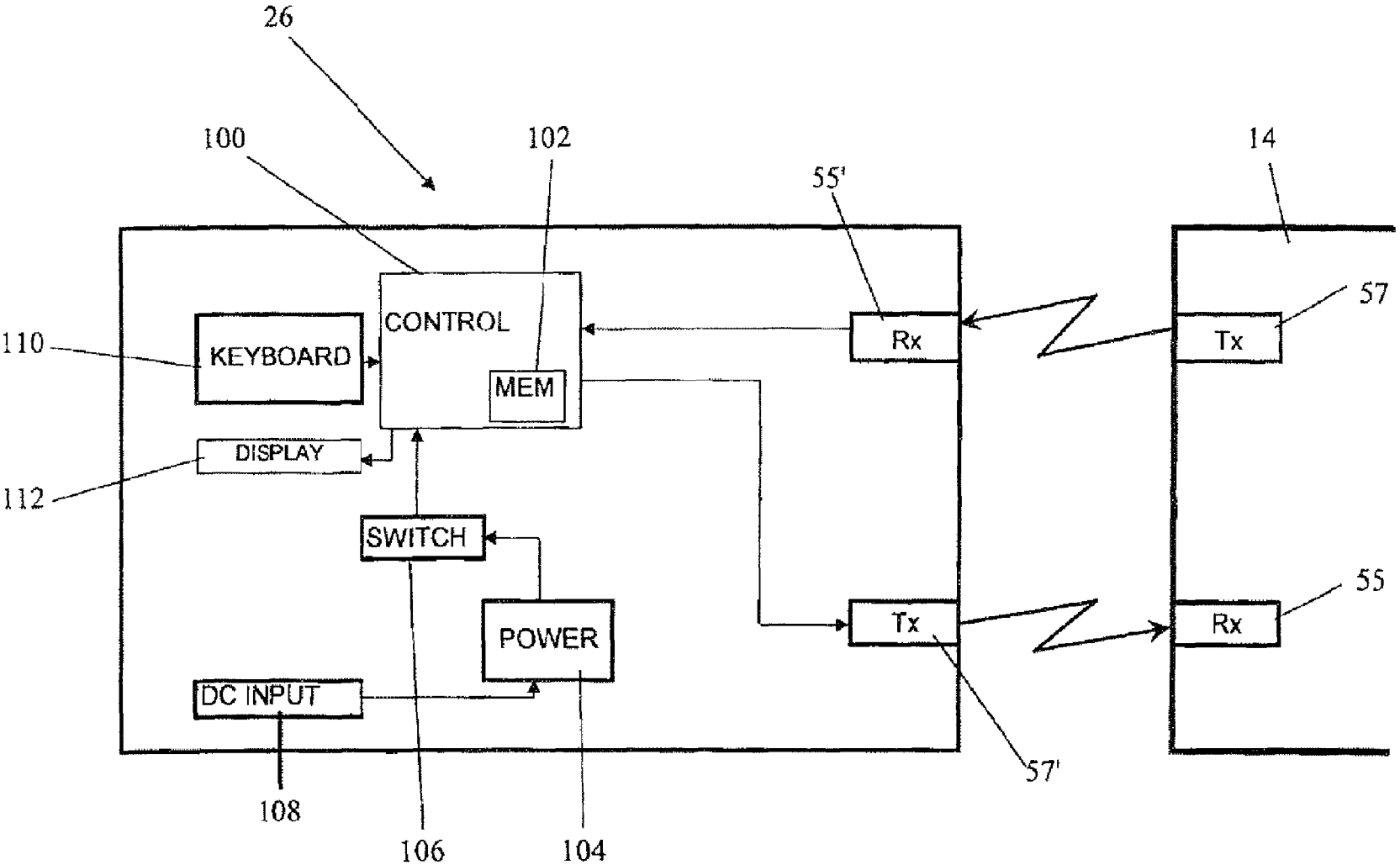
FIG. 11 is a schematic illustration of a portable terminal used to interrogate the seal of the present invention.

As seen, all components of the ESE 42 are mounted onto a main circuit board 47 (FIGS. 6A-6D and 8), and are controlled by control unit 52. Control unit 52 is powered by means of a power supply 50, and in turn, selectively powers the remaining operational components as indicated in FIG. 4, according to need. Power supply is illustrated in (FIGS. 6A, 6C and 8) as a battery, although a power supply of a different type may be provided in place thereof or in addition thereto. Non-limiting examples of such alternative types of power supply may include a photovoltaic cell, or a 'passive' inductive power source, such as known to be used in passive or semi-passive RFID tags, powered by an interrogating RF field which could be provided by apparatus mounted onto stationary terminals 16 (FIGS. 1A-1C), or portable terminal 26 (FIGS. 1A and 11).

In order to impart failsafe capabilities to seal 14, such that once activated opening of housing 45 will always cause an alarm signal to be emitted, ESE 42 is provided with a security switch 66, seen in FIGS. 4, 6A-6D and 8. As will be appreciated from the description below, once the security switch has been activated, it cannot be deactivated during normal operation of the seal 14, without causing an alarm signal to be emitted.

In the present embodiment of the invention, the security switch is provided by a normally open microswitch 66, operated via a uni-directional actuator member 68. Depression of microswitch 66 is used to close the electrical circuit of the ESE 42, thereby arming the LOS seal 14. Once the seal is armed, any break in the electrical circuit will cause an alarm signal to be emitted, as described above.

Figure 7B:
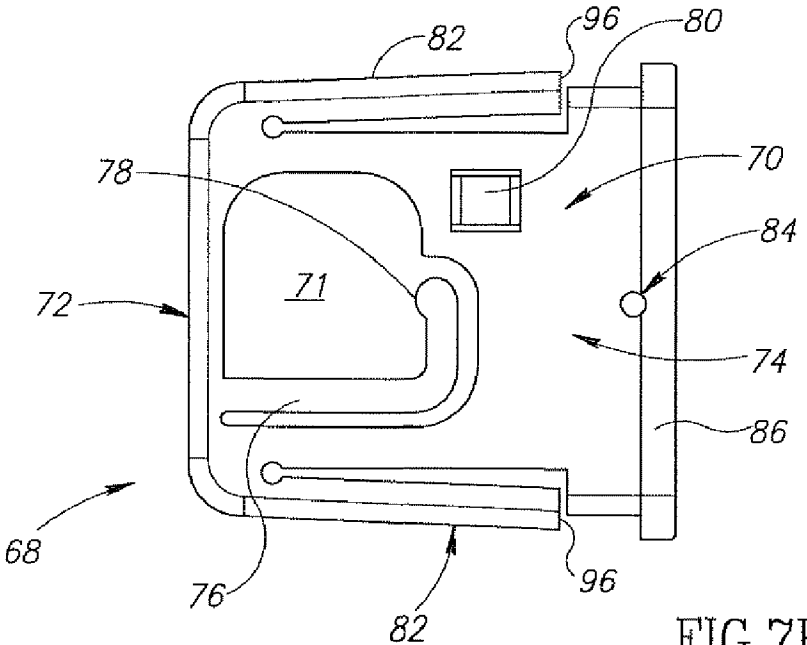
FIGS. 7A, 7B and 7C are perspective, plan and side views of the actuator member, respectively, seen in FIGS. 6A-6D.
Figure 7C:
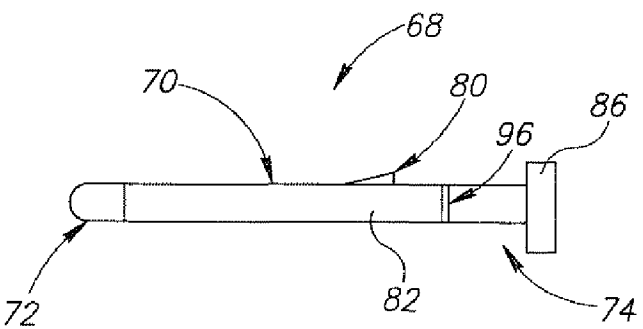
Figure 7A:
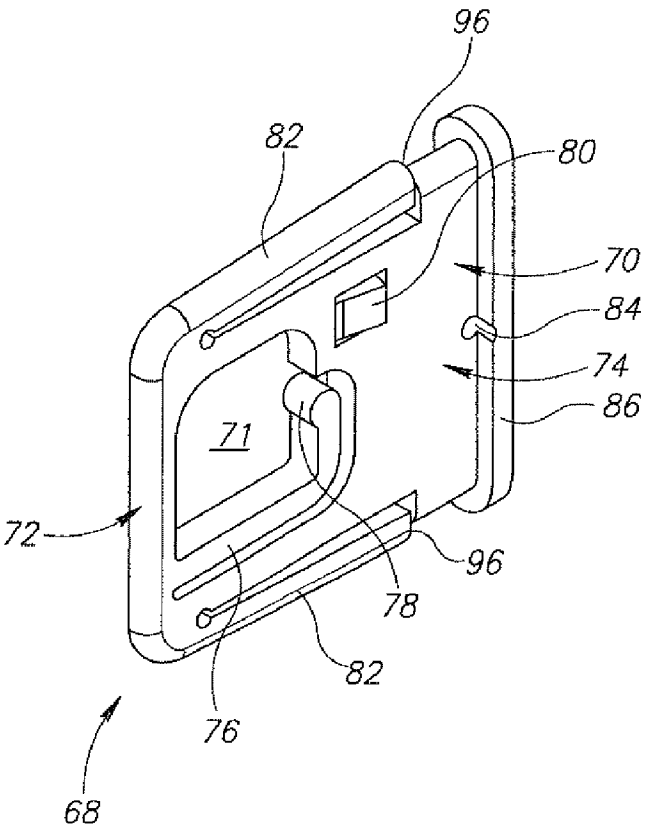

Referring now to FIGS. 7A-7C, in accordance with the present embodiment of the invention, actuator member 68 is seen to have a generally planar body 70 formed of a flexible, molded plastic, defining an intermediate opening 71 formed between a rear portion 72 and a front portion 74. A flexible L-shaped arm 76 extends typically from the rear portion 72 towards the front portion 74, and defines a generally rounded, rearward-facing tip 78 for engagement with microswitch 66. Actuator member 68 is also formed with a locator tooth 80, and pair of forward facing pawls 82 provided at the sides of body 70. Pawls 82 have a natural position of rest which is laterally displaced from the reminder of body 70, as seen, inter alia, in FIG. 7B. There is also provided an aperture 84 formed adjacent a front lip 86, for receiving therethrough a safety pin 88 of safety catch 90, seen in FIGS. 5A, 5B and 6A.

Referring again to FIGS. 6A-6C, during the assembly of ESE 42, after the placement and fastening of main board 47 onto base 46, actuator member 68 is inserted into base 47 through a slot 92 (FIG. 6A) formed in a side wall 94 thereof, and positioned such that microswitch 66 is positioned within the opening 71 of actuator member 68, facing tip 78 of arm 76. At this time, as seen in FIGS. 5B and 6A, safety pin 88 extends through aperture 84 (FIGS. 7A and 7B), thereby preventing complete insertion of actuator member 68, and thus also preventing depression of microswitch 66 by tip 78, and thus preventing accidental or unintended arming of seal 14. During this time, pawls 82 are compressed against the side of body 70.

Subsequent removal of safety pin 88 from aperture 84 permits the complete insertion of actuator member 68 through slot 92 such that front lip 86 is juxtaposed to the side wall 94. As actuator member 68 is fully inserted, tip 78 engages and depresses microswitch 66, thereby completing the electrical circuit within ESE 42, and arming seal 14. At this time, in order to prevent accidental removal of actuator member 68, which would release microswitch 66 and set off an alarm, front facing tips 96 (FIGS. 6D, 7A, 7B and 7C) of pawls 82 move clear of inward-facing surface 98 (FIG. 6D) of side wall 94, thereby allowing pawls 82 to spring outwards from body 70 to their natural, non-compressed position. This has the effect of causing front facing tips 96 of pawls 82 to become disposed opposite and virtually touching inward-facing surface 98 of side wall 94, thereby to cause actuator member 68 to become locked in position within base 46, so as to maintain microswitch 66 in its depressed position, and seal 14 in an armed state.

Referring now briefly to FIG. 11, computerized portable terminal 26 includes a control unit 100 having associated therewith a memory 102; ultrasound transducers employed as a receiver 55' and a transmitter 57' similar to those shown and described hereinabove in conjunction with FIG. 4; a power source 104, which may be either a single use or rechargeable, in which case a DC input jack 108 may also be provided for use therewith; a power switch 106; a keyboard 110 for entering commands or data; and a display 112. The ultrasound transducer pair may be replaced by a suitable integral ultrasound transceiver, as shown and described hereinabove in conjunction with FIG. 4.

It will be appreciated by persons skilled in the art that a particular advantage of the present invention is that with the exception of providing a hollow bolt, the essential mechanical nature of the LOS seal 14 of the invention is unchanged, and that it may be used in exactly the same way as a simple mechanical seal with, of course, the additional fastening thereto of the electronic seal element 42.

In addition to both the mechanical and electronic security aspects of seal 14, as mentioned above, seal 14 also includes computer memory which is able to store preprogrammed data, which includes container identification details, bill of lading, and other data which may include an event log noting closure and locking of the seal, opening thereof, and notation of the geographical position of the container.

As described hereinabove in conjunction with FIGS. 1A-1C, stationary terminals 16 and portable terminal 26 are employed so as to communicate with each seal 14 when the container 12 to which it is attached is at a secured location 10. All communications are performed across the wireless interface between the transducer pairs 55, 57 and 55', 57'.

All communications require data transmission and reception between the transducer pairs. The following is an example of a typical protocol thereof:

Data Transmission

Structure of Individual Bit:

"1"—transmission pulse width of 5 Msec at a resonant frequency of 40 kHz

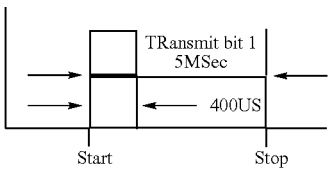

"0"—transmission pulse width of 5 Msec at a resonant frequency of 40 kHz

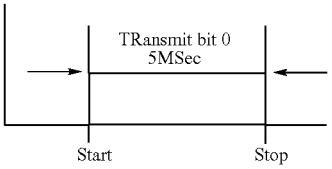

Structure of Individual Byte

A single Byte is made up of ten Bits. The first Bit is a 1 START Bit; this is followed by eight Bits of data; finally there follows a STOP Bit similar to the START Bit.

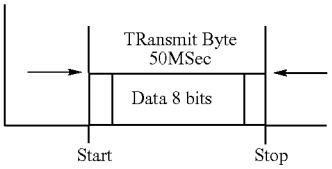

Structure of Transmission

The transmission is composed of a number of Bytes, as follows:

First Byte DATA=0xAA
Second byte: COMMAND
N−1 Data Bytes
Check Sum
Last Byte DATA=0x55

| 0xAA | Command | Data1 | Data x | Data n | Check sum | 0x55 |
|---|---|---|---|---|---|---|

After each Byte there follows a delay of 50 Msec

Data Reception

When the system is in a READY state, it awaits commencement of reception by means of an INTERRUPT. At this point in time the reception times and all registers are zeroed. At the commencement of reception, the first Bit received becomes the START or SYNC, at which time the system checks the logic pulse width, and correspondingly determines the time until notation of the ZERO or ONE logic Bit. The times of checking the reception port must be exceedingly precise in order to avoid shift in data reception.

It will also be appreciated that different communications scenarios exist. The most basic scenarios, which may be implemented as per the above-described exemplary protocol, are as follows:

Initial Programming of Seal 14

Both seals 14 and containers 12 have serial numbers. The serial number of container 12 is displayed in a place which is clearly visible. Each container 12 further has a bill of lading, which includes information relating to the cargo being transported, point and time of departure, point and scheduled time of arrival, and so on. As the control system contains all of the bill of lading information for each container, all that is required is to coordinate between each seal 14 and the specific container to which it is attached.

Accordingly, once a container 12 has been locked and secured with a seal 14, terminal 26 will be employed so as to request the serial number of the seal 14, programmed during assembly at the factory. An operator will then enter the number of the container 12 by use of keyboard 110 so as to access the bill of lading information which may be stored in the terminal memory 102, and then transmit this data to ESE 42 for storage in seal memory 59. At the same time, the serial number of the seal 14 is transmitted to field control center 18 for storage in a central database.

Interrogation of Seal 14

At predetermined times when a container 12 either arrives at a secure location 10 or subsequent thereto, the seal 14 of each container is interrogated by a stationary terminal 16. Alternatively, or in addition, interrogation may be effected by use of portable terminal 26. During such interrogation, the container number is transmitted to the seal 14, in response to which the seal 14 transmits its serial number back to the stationary terminal or portable terminal.

Both terminal 26 (or control center) and seal 14 effect a comparison of the two serial numbers. If the container number transmitted to the seal is incorrect, then it will not transmit its own serial number in return.

After verification of the legality of the seal and container numbers, seal 14 transmits data to terminal 26 or stationary terminal 16, indicating the state of the seal 14.

In the event that seal 14 has been broken or otherwise tampered with causing mechanical shock thereto or if the state of charge of the battery is low, this information will be transmitted to stationary terminal 16 or terminal 26. This then causes emission of audible and ultrasonic signals via the seal transmitter and optionally by the system. As mentioned above, in such a situation, the LED 53 will also flash.

Figure 12:
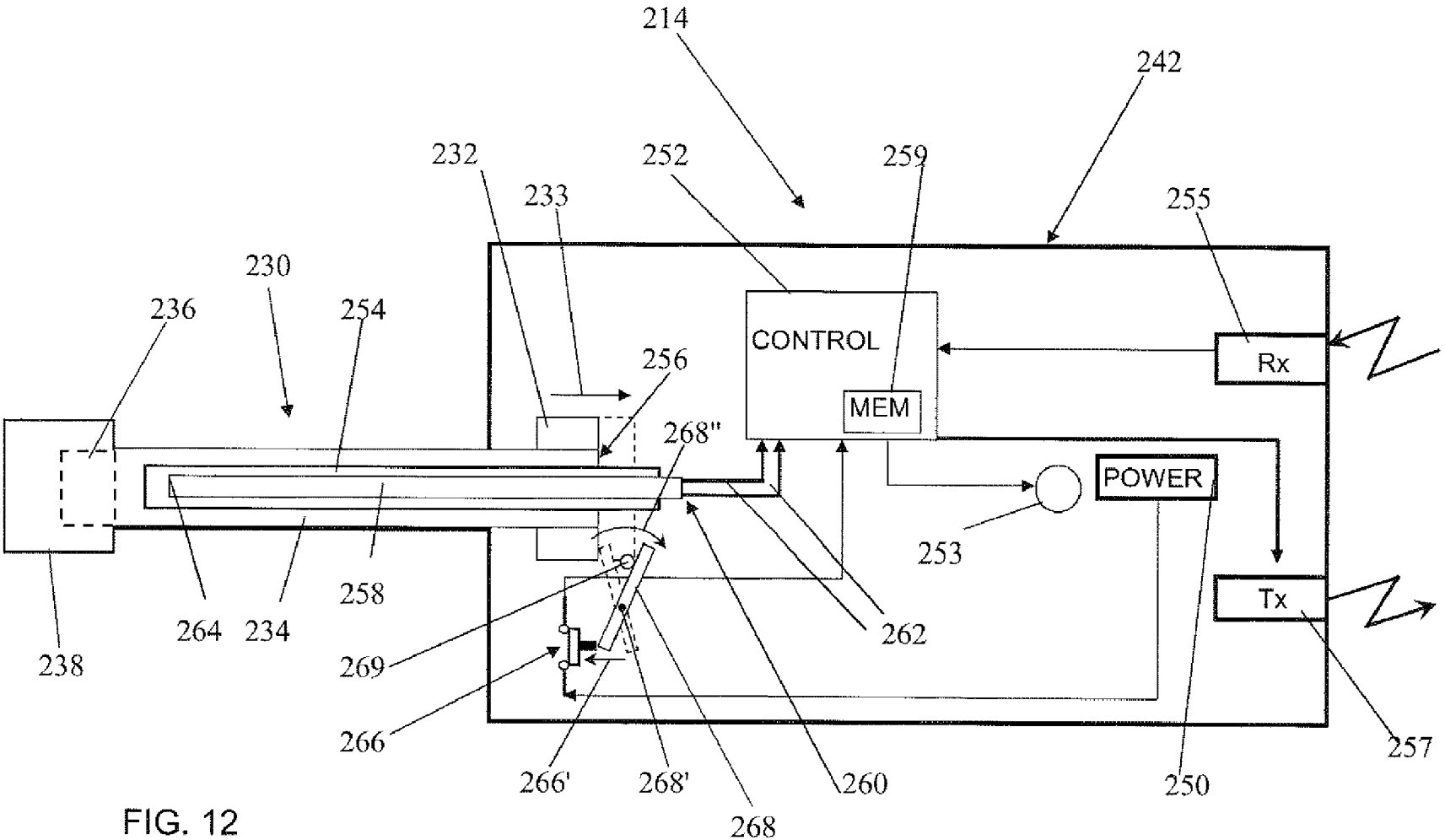
FIG. 12 is a block diagram representation of the seal depicted in FIG. 3, in accordance with an alternative embodiment of the present invention.

Referring now to FIG. 12, there is seen, in block diagram form, a seal referenced generally 214, constructed and operative in accordance with an alternative embodiment of the present invention. Seal 214 is generally similar to seal 14 shown and described above, inter alia, in conjunction with FIGS. 4, 5A, 5B, 6A, 6C, 8, 9 and 10. Accordingly, components common to both the present seal 214 and the above-described seal 14 are denoted by similar reference numerals, but with the addition of a "2" prefix, and may be described again herein only insofar as may be necessary to understand the present embodiment.

In order to impart the basic, mechanical portion of LOS seal 14 with alarm capabilities which will emit alarm signals in response to an attempt to cut through the bolt 230 (FIG. 12), bolt protection sensor 258 is preferably provided as a solid state, finger shaped printed circuit board. The circuit board carries thereon an electrical circuit which extends from a connector end 260 which is connected by wire conductors 262 to control unit 252 and to a sensor tip 264, which may be a resistive, capacitive, inductive, piezoelectric or other suitable sensor element. Once ESE 242 has been activated, as described below, control unit 252 constantly monitors the state of electrical activity within bolt protection sensor 258, as described above in conjunction with seal 14 and ESE 42.

As seen, all components of the ESE 242 are mounted onto a main circuit board 247 (similar/comparable to circuit board 47 of FIGS. 6A, 6C and 8), and are controlled by control unit 252. Control unit 252 is powered by means of a power supply 250, and in turn, selectively powers other operational components depicted in FIG. 12, according to need.

In order to impart failsafe capabilities to seal 214, ESE 242 is provided with a security switch 266. Once the security switch has been activated, it cannot be deactivated during normal operation of the seal 214, without causing an alarm signal to be emitted.

In the present embodiment of the invention, the security switch is provided by a normally open microswitch 266, operated via a uni-directional actuator member 268. Actuator member 268 is mounted about a pivot axis 268' for pivoting thereabout upon engagement of bolt 230 with locking element 238. As ESE 242 and bolt 230 are forced together with locking element 238, bolt 230 is displaced inwardly into ESE 242, as shown by arrow 233, so as to engage actuator member 268, thereby causing it to pivot about pivot axis 268' as shown by arrow 268". This motion of actuator member 268 is operative to engage and depress microswitch 266 as shown by arrow 266', thus closing the electrical circuit and arming ESE 242. Once actuator member 268 has been pivoted so as to arm seal 214, it is locked in this position by any suitable mechanical, electrical, magnetic or electro-magnetic locking means 269. Once the seal is armed, any break in the electrical circuit will cause an alarm signal to be emitted, as described above.

It will be appreciated by persons skilled in the art that the scope of the present invention is not limited by what has been specifically shown and described hereinabove, merely by way of example. Rather, the scope of the present invention is defined solely by the claims, which follow.

The invention claimed is:

1. A tamper-proof electronic security seal which includes:

a. a bolt and a locking element, said bolt having a head and a hollow shank extending therefrom having a longitudinal bore formed therein, said shank being dimensioned to pass through a lock hasp and having a free end formed for locking engagement with said locking element; and b. an electronic seal element formed for mechanical connection to said bolt head, and including:

an electrical power source;

(ii) a control unit;

(iii) communications means responsive to said control unit; and (iv) a sensor adapted for insertion into said longitudinal bore of said shank, and connected to said control unit;

wherein, in response to a severing of said shank and said sensor inserted therein, said control unit is operative to activate said communications means to emit an alarm signal;

wherein said communications means is ultrasonic communications means adapted to communicate with external ultrasonic communications means associated with a security system at a secured location; and wherein said ultrasonic communications means is adapted to sense mechanical shock, thereby to function also as a means for sensing an attempt to mechanically tamper with said electronic seal element.

2. A tamper-proof electronic security seal according to claim 1, wherein said electronic seal element includes a housing for said power source, control unit and communications means, wherein said housing is configured to fasten about said bolt head.

3. A tamper-proof electronic security seal according to claim 2, wherein said electronic seal element also includes additional sensor means operative to provide a predetermined alarm signal to said control unit in response to an attempt to tamper with said housing, and wherein in response to said predetermined alarm signal said control unit is operative to activate said communications means to emit an alarm signal.

4. A tamper-proof electronic security seal according to claim 3, wherein said additional sensor means includes vibration sensor means.

5. A tamper-proof electronic security seal according to claim 2, wherein said control unit is operative to issue an alarm signal in the event of an unplanned drop in electrical power during operation of said electronic seal element.

6. A tamper-proof electronic security seal according to claim 5, wherein said communications means includes at least ultrasonic transmission means, and wherein said alarm signal is operative to activate said ultrasonic transmission means to emit ultrasonic signals within the responsive range of on-site ultrasound responsive alarm units.

7. A tamper-proof electronic security seal according to claim 6, wherein said ultrasonic signals are within the responsive range of ultrasound responsive mammals.

8. A tamper-proof electronic security seal according to claim 1, wherein said sensor is a solid state, probe shaped sensor.

9. A tamper-proof electronic security seal according to claim 8, wherein said solid state sensor includes a circuit board carrying thereon an electrical circuit which extends from a connector end which is connected by wire conductors to said control unit, and to a sensor element located at a probe end located distally from said connector end.

10. A tamper-proof electronic security seal according to claim 9, wherein said sensor element is of the type selected from the group which consists of resistive, capacitive, inductive, or piezoelectric.

11. A tamper-proof electronic security seal according to claim 1, wherein said electronic seal element also includes a security switch operative to facilitate the provision of power from said power source to said control unit and which, after activation, cannot be deactivated during normal operation of said electronic seal element without causing a break in the electrical power supply.

12. A tamper-proof electronic security seal according to claim 11, including actuator means operative for engaging and depressing said security switch, and means for locking said actuator means in its position of engagement with said security switch.

13. A tamper-proof electronic security seal according to claim 11, including a safety catch for preventing unintended arming of said electronic seal element.

14. A tamper-proof electronic security seal according to claim 1, also including a programmable memory for storage of container and container-contents related data, and wherein said control unit is operative to selectably store data communicated from external ultrasonic communications means associated with a security system at a secured location, and is further operative to selectably provide thereto data stored in said programmable memory.

15. A tamper-proof electronic security seal according to claim 1 in combination with an improved security system for cargo containers located at a secured location, wherein said system includes:

a plurality of uniquely identifiable security seals having ultrasonic communications means for the ultrasonic reception and transmission of data pertaining to a preselected cargo container;

at least one ultrasound communications terminal located at a secured location, for the exchange of data with said ultrasonic communications means of said security seals when in the angular field of view thereof.

16. An improved security system according to claim 15, also including a control system for receiving and processing real time data relating to the specified cargo containers, and wherein said at least one ultrasound terminal includes means for the transmission of data received from said security seals to said control system.

17. An improved security system according to claim 16, wherein said control system includes at least one control center for receiving and storing data received from said at least one ultrasound terminal relating to the specified cargo containers.

18. An improved security system according to claim 17, wherein said security system is hierarchical, wherein said at least one control center includes at least two lower level control centers for exchanging data with said at least one ultrasound terminal, said system also including at least one higher level control center for the storage of data relating to the cargo containers and for exchanging data with each of said at least one lower level control center.

19. An improved security system according to claim 18, wherein said secured location is a mobile facility for carrying one or more cargo containers thereon, and said system also includes a GPS link between said lower level control centers and at least one of said higher level control center for facilitating the monitoring of the geographical location and secure status of all secured cargo containers at a secured location.

20. An improved security system according to claim 15, wherein each said at least one ultrasound communications terminal is selected from the group consisting of:

a stationary ultrasound communications terminal arranged at a location within said secured location predetermined to be within the angular field of view of at least one of said security seals so as to communicate therewith; and a portable ultrasound communications terminal for communicating with at least one of said security seals when in the angular field of view thereof.

21. An improved security system according to claim 15, wherein each said uniquely identifiable security seal includes a tamper-proof electronic security seal constructed and operative in accordance with claim 1.

22. An improved security system according to claim 15, wherein each said uniquely identifiable security seal includes a tamper-proof electronic security seal constructed and operative in accordance with claim 8.

23. An improved security system according to claim 15, wherein each said uniquely identifiable security seal includes a tamper-proof electronic security seal constructed and operative in accordance with claim 14.

* * * * *